United States Patent [19]

Beal

[11] Patent Number: 4,819,875

[45] Date of Patent: Apr. 11, 1989

[54] CONTOUR CONTROL DEVICE FOR ROTARY IRRIGATION SPRINKLERS

[75] Inventor: Glenn I. Beal, Vista, Calif.

[73] Assignee: Rain Bird Consumer Products Mfg. Corp., Glendora, Calif.

[21] Appl. No.: 64,851

[22] Filed: Jun. 22, 1987

[51] Int. Cl.[4] ..... B05B 3/06

[52] U.S. Cl. ..... 239/97; 239/230; 239/240; 239/248; 239/DIG. 1

[58] Field of Search ..... 239/204–206, 239/237, 239, 240, 241, 246, 248, 225.1, 230, 97, 98, DIG. 1

[56] References Cited

U.S. PATENT DOCUMENTS

| | | | |
|---|---|---|---|
| 2,414,052 | 1/1947 | Martin | 239/206 |
| 2,571,763 | 10/1951 | Robbins | 239/DIG. 1 |
| 2,739,839 | 3/1956 | Greener et al. | 239/97 |
| 4,265,403 | 5/1981 | Bonetti | 239/206 |
| 4,613,077 | 9/1986 | Aronson | 239/240 |

*Primary Examiner*—Andres Kashnikow
*Assistant Examiner*—Karen B. Merritt
*Attorney, Agent, or Firm*—Kelly, Bauersfeld & Lowry

[57] ABSTRACT

A contour control device for use with rotary irrigation sprinklers to water irregular areas about the sprinkler. The device includes a housing defining a chamber within which is disposed a throttling means comprising a flexible, resilient band and a plurality of adjustment pins which cooperate with a rotating inlet to the sprinkler to throttling the volume of water flow to the sprinkler in accordance with the rotary position of the sprinkler relative to the housing.

42 Claims, 5 Drawing Sheets

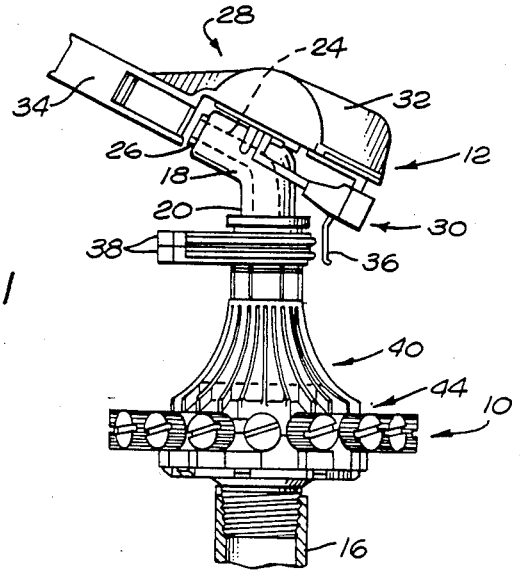
FIG. 1
FIG. 2
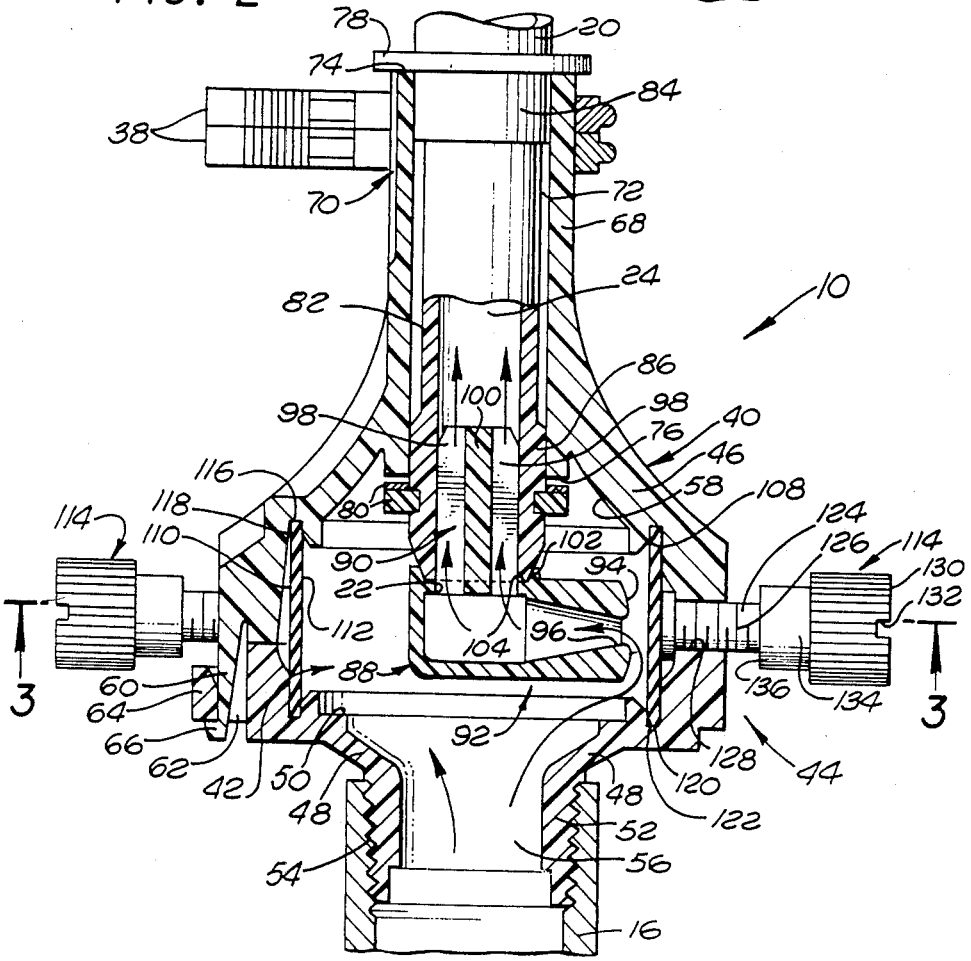

CONTOUR CONTROL DEVICE FOR ROTARY IRRIGATION SPRINKLERS

BACKGROUND OF THE INVENTION

This invention relates to irrigation sprinklers of the rotary type, and more particularly to a new and improved adjustable contour control device for permitting a rotary sprinkler to be used to irrigate highly irregular as well as regular arcuate shaped areas.

There are many instances where it is desirable to use a conventional rotary sprinkler, such as that known in the art as an impulse or impact drive type sprinkler, to water a surface area which is not circular or of a constant radial distance from the sprinkler. For example, when a lawn or garden is to be irrigated, frequently the area to be watered has an irregular boundary created by sidewalks, driveways, streets, buildings, etc. onto which it is undesirable to spray water from the sprinkler. Since most conventional rotary sprinklers spray a stream of water a constant radial distance from the sprinkler, the use of such a sprinkler to water an irregular shaped area may be highly undesirable.

While numerous rotary type sprinklers have been disclosed in the prior art which attempt to provide the capability of watering irregular surface areas, which sprinklers have tended to be relatively complex in design, expensive to manufacture, and susceptible to clogging, jamming and breakage, and have generally met with only limited acceptability. Accordingly, there remains a need for a relatively inexpensive, highly reliable and effective contour control device for use with a rotary sprinkler which is simple in design yet capable of permitting easy and precise adjustment of the spray from the sprinkler to conform to the specific regular or irregular area to be watered.

As will become more apparent from the following, the present invention fulfills this need in a highly unique and novel manner, as well as providing other and further advantages.

SUMMARY OF THE INVENTION

The present invention comprises a contour control device operable in a highly reliable and effective manner to selectively adjust the flow of water to a sprinkler nozzle in accordance with the rotary position of the nozzle relative to the device, thereby to control the distance the wetted area or pattern of water extends radially outwardly from the sprinkler. The control device is relatively simple in design, inexpensive to manufacture, and is constructed in such a manner as to permit a sprinkler operator to quickly and easily adjust the flow within relatively wide limits to obtain virtually any desired irregular or regular wetted pattern about the sprinkler.

The control device includes a throttling means for controlling the flow of water from a chamber to the sprinkler nozzle in accordance with the rotary position of the sprinkler relative to the chamber. The throttling means comprises a flexible, resilient band disposed in the chamber in radially-spaced, confronting relation to a radially-opening inlet to the sprinkler, and a plurality of adjustable pins which project into the chamber and abut the resilient member to control the radial spacing between the resilient member and the radially-opening sprinkler inlet. Through selection of the radial spacing being the resilient member and the sprinkler inlet, the volume of water permitted to flow from the chamber into the sprinkler inlet can be controlled, thereby controlling the distance of water throw from the sprinkler nozzle.

In one embodiment, the sprinkler is an impact drive type sprinkler and the inlet from the chamber comprises a tubular elbow attached to the sprinkler inlet and projecting radially into a chamber formed by a stationary housing to which the sprinkler is rotatably mounted. As the sprinkler rotates about the housing, the attached tubular elbow also rotates within the chamber. A plurality of adjustable pins project peripherally from the housing and can be radially adjusted from outside the housing to deform the band within the chamber relative to the elbow inlet.

In another embodiment, the contour control device is formed as part of a pop-up ball drive sprinkler assembly, and includes a deformable resilient band stationarily mounted within a chamber and having a plurality of radially-adjustable pins for controlling the radial spacing between the band and a radially-extending inlet to the sprinkler nozzle. As the ball drive assembly rotates the sprinkler nozzle about its vertical axis, the radially-extending inlet rotates within the chamber and the radial spacing between the resilient band and the radial inlet as selected by radial adjustment of the pins controls the volume of flow of water from the chamber to the sprinkler nozzle.

Many other features and advantages to the present invention will become more apparent from the following detailed description taken in conjunction with the accompanying drawings which disclose, by way of example, the principles of the invention.

BRIEF DESCRIPTION OF THE DRAWINGS

FIG. 1 is a elevational view of a contour control device for rotary irrigation sprinklers embodying the principles of the present invention, and shown in conjunction with an impact drive type rotary irrigation sprinkler;

FIG. 2 is a fragmentary enlarged cross-sectional view of the contour control device shown in FIG. 1;

DETAILED DESCRIPTION OF THE PREFERRED EMBODIMENTS

Figure 3:
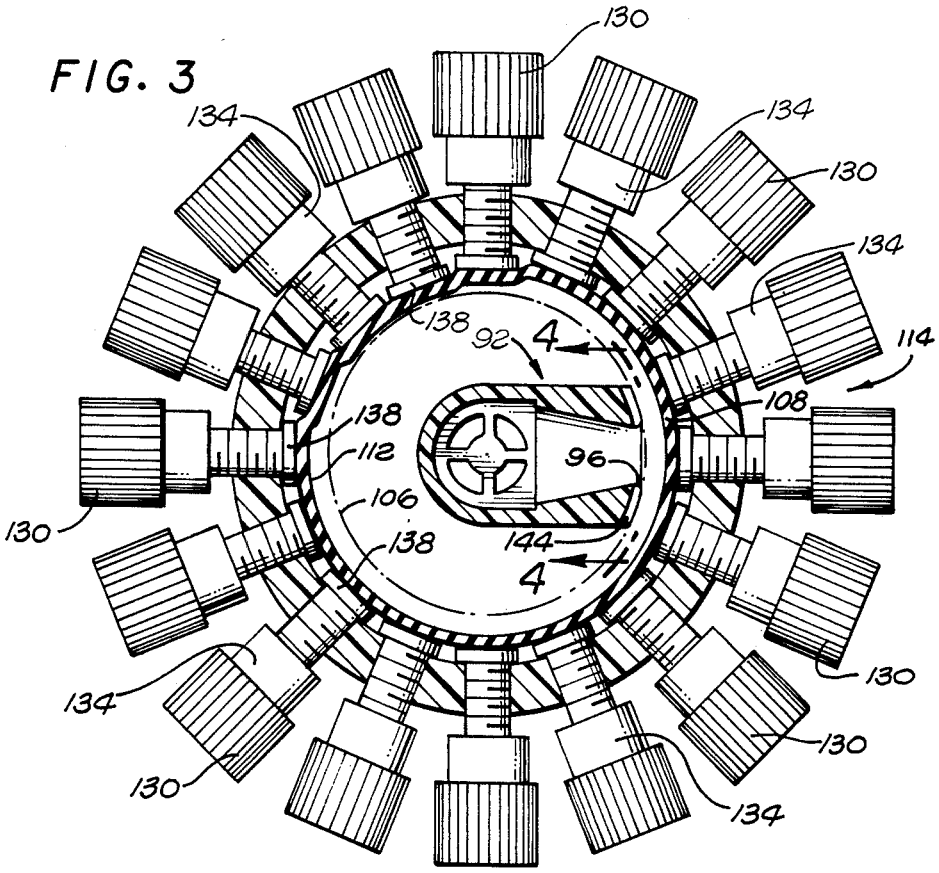
FIG. 3 is a sectional view taken substantially along the line 3—3 of FIG. 2.

As shown in the exemplary drawings, the present invention is embodied in a new and improved contour control device, generally designed by reference numeral 10, for use with a rotary irrigation sprinkler to selectively control the water pattern or contour shape sprayed from the sprinkler during use. In one embodiment illustrated in FIG. 1, the control device 10 is used with an impulse or impact drive type sprinkler 12 of generally conventional design and in a second embodiment illustrated in FIG. 9, the control device is formed as an integral component of a ball drive type sprinkler 12', also of generally conventional design.

As seen in FIG. 1, the control device 10 is stationarily coupled to a pipe or riser 16 through which pressurized water is supplied from a suitable source, and supports the sprinkler 12 for rotation about a generally vertical axis through the control device. The sprinkler 12, which may be of metal or plastic construction, herein comprises a body 18 having a downwardly extending, generally vertically oriented tubular stem 20 with an inlet 22 at the bottom (best seen in FIG. 2) opening to an internal flow passage 24 (shown in broken lines in FIG. 1) extending through the body and which terminates a nozzle 26 from which water is injected upwardly and radially outwardly into the atmosphere from the sprinkler.

Mounted on the body 18 of the sprinkler 12 are an oscillatory impact drive arm assembly 28 of conventional design, and a selectively operable reversing trip mechanism 30, also of conventional design. As will be readily apparent to those of ordinary skill in the sprinkler art, the impact drive arm assembly 28 includes a spring biased drive arm 32 to one end of which is coupled a drive spoon 34 which oscillates into and out of the water stream from the nozzle 26 to effect rotation of the sprinkler body 18, and the trip mechanism 30 includes a downwardly projecting trip lever 36 which cooperates with a pair of adjustable trip collars 38 coupled to the control device 10 for permitting the sprinkler to be operated in either a part circle or full circle mode.

When in operation, pressurized water from the riser 16 flows through the control device 10 to the sprinkler 12 as indicated by the arrows in FIG. 2, and is ejected upwardly and radially outwardly from the nozzle 26, the drive spoon 34 of the impact drive arm assembly 28 operating to periodically interrupt the ejected water stream and rotate the sprinkler in incremental steps about its axis of rotation. As the ejected water stream leaves the nozzle 26, the stream breaks up and falls to the ground producing a wetted area about the sprinkler 12 extending from adjacent the body 18 to a distance radially outwardly therefrom governed by the size of the nozzle, the water supply pressure, and the water flow rate to the nozzle.

In accordance with the present invention, the contour control device 10 operates in a highly reliable and effective manner to selectively adjust the flow of water to the sprinkler nozzle in accordance with the rotary position of the sprinkler relative to the device, thereby to control the distance the wetted area or pattern extends outwardly from the sprinkler. Moreover, the control device 10 is relatively simple in design, inexpensive to manufacture, and constructed in such a manner to permit a sprinkler operator to quickly and easily adjust the flow within relatively wide limits to obtain virtually any desired irregular or regular wetted pattern about the sprinkler.

Toward the foregoing ends, in the embodiment of FIG. 1, as can best be seen in FIGS. 2 and 3, the control device 10, which preferably is made of molded plastic, includes a generally cylindrical housing 40 forming an internal chamber 42 of circular horizontal cross-section and into which water from the riser 16 flows, and adjustable throttling means, generally designated by reference numeral 44, for selectively controlling the flow of water from the chamber to the sprinkler 12 in accordance with rotary position of the sprinkler body 18 relative to the device. The throttling means 44 is adjustable to control the flow of water to the sprinkler 12 between the limits of full, unrestricted flow, and the minimum flow necessary to operate the impact drive arm assembly 28 to rotate the sprinkler, the minimum flow required being dictated by the particular sprinkler and the size nozzle 26 used.

Figure 7:
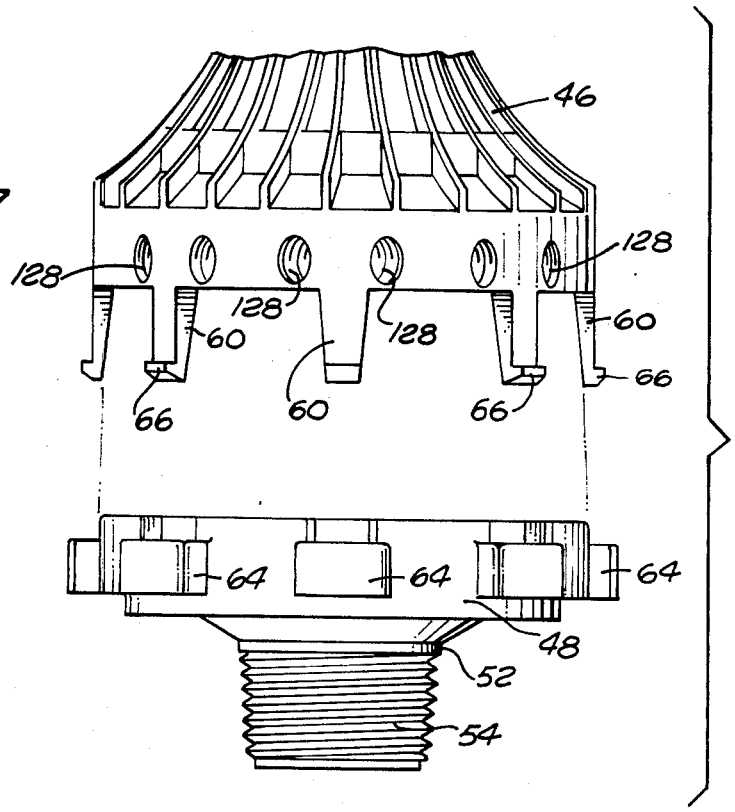
FIG. 7 is a fragmentary exploded elevational view illustrating assembly of the contour control device of FIG. 1.

More specifically the control device housing 40 herein is formed of upper and lower sections 46 and 48, respectively, each of generally circular horizontal cross-section with the lower section 48 being generally cup-shaped with an inside wall surface 50 forming a lower portion of the chamber 42, and having a downwardly extending tubular end portion 52 of reduced diameter formed with external threads 54 for threadably coupling the control device 10 to the riser 16 and forming an inlet passage 56 to the chamber 42. The upper section 46 herein is generally bell-shaped in appearance (see FIGS. 2 and 7) with an inside wall surface 58 forming an upper portion of the chamber 42, and herein is snap-fit together with the lower section 48 through a plurality of downwardly extending hook-shaped locking fingers 60, herein eight in number, which project through corresponding channels 62 formed by radially projecting walls 64 disposed peripherally around the lower section, radial projections 66 on the fingers engaging the undersides of the channel forming walls of the lower section to lock the upper and lower sections firmly together.

To rotatably mount the sprinkler 12 to the control device 10, the upper section 46 of the housing 40 includes an upwardly extending tubular portion 68 of reduced diameter about which the trip collars 38 are mounted, and within which is formed a cylindrical journal bore 72 terminating in an upwardly facing annular radial shoulder 74 at the top, and a downwardly facing annular radial shoulder 76 at the bottom. The downwardly extending stem 20 of the sprinkler body 18 projects through the journal bore 72 so that the inlet opening 22 extends into the chamber 42 below the bottom radial shoulder 76.

To adjustably mount the trip collars 38 to the control device 10, a plurality of axially elongated ribs 70 project radially outwardly at arcuately spaced locations about the tubular portion 68, and cooperate with axial grooves formed in the trip collar bodies to releasably secure the collars in the desired positions. For part circle operation, the trip collars 38 are positioned adjacent the upper end of the tubular portion as shown in FIG. 1, and for full circle operation of the sprinkler 12, the collars can be moved downwardly below a circumferential rib 71 provided about the tubular position to a position below the end of the trip lever 36.

The inside diameter of the journal bore 72 is formed to be slightly larger than the outside diameter of the tubular stem 20 so as to permit rotation therebetween, and an enlarged diameter radial flange 78 is provided around the tubular stem about the journal bore and which abuts the upwardly facing radial shoulder 74 to support the sprinkler 12 on the control device housing 40 when the sprinkler is not in operation. To rotatably constrain the tubular stem 20 within the journal bore 72 and seal the chamber 42 at its top, a pair of bearing washers 80 of conventional design are provided which extend radially outwardly about the tubular stem above the inlet opening 22 and below the journal bore. When water pressure is admitted to the chamber 42 and into the passageway 24, the sprinkler body 18 is urged upwardly until the upper of the two bearing washers 80 engage the downwardly facing shoulder 76 at the bottom of the journal bore 72. To reduce friction during rotation of the sprinkler body 18, a central section 82 of the stem 20 herein is formed to have a reduced outside diameter, thereby to form upper and lower radial lands 84 and 86, respectively, which laterally support the sprinkler body within the journal bore 72.

For directing water from the chamber 42 to the passageway 24 of the sprinkler 12, a tubular elbow 88 is coupled to the lower end portion of the stem 20, the elbow herein having an axially directed portion 90 extending upwardly within the passageway, and a radially extending portion 92 terminating in an outer end face 94 having an inlet opening 96 to the chamber formed therein. Preferably, the elbow 88 is coupled by any suitable means such as a snap or press fit with stem 20 to effectively form a radial extension of the stem, and is positioned relative to the sprinkler body 18 so that the radially directed center line of the inlet opening 96 is aligned along a axis parallel with the radially directed center line of the outlet opening of the nozzle 26.

In this instance, as best seen in FIGS. 2 and 3, the axially directed portion 90 of the elbow 88 is formed by four axially extending and diametrically opposed vanes 98 which project radially from a central support post 100, and which are dimensioned to be press-fit within the passageway 24 so as to couple the sprinkler body 18 with the elbow 88 for rotation together as a single unit. An upstanding cylindrical rim 102 disposed about the lower portion of the vanes 98 at the junction of the axial portion 90 and the radial portion 92 of the elbow 88 forms a groove 104 which abuts against the lower end of the stem 20 to seal and limit upward movement of the axial portion into the passageway 24. With this configuration, the axially directed portion 90 of the elbow 88 not only functions to attach the elbow to the sprinkler body 78, but also provides vanes 98 which straighten and smooth the water as it flows from the inlet opening 96 through the elbow to the passageway 24.

Figure 4:
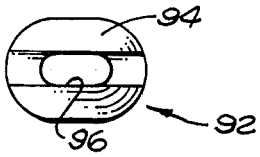
FIG. 4 is a elevational view as seen in the direction of the line 4—4 of FIG. 3.

During the operation of the sprinkler 12, as the sprinkler rotates about its axis, the outer end 94 of the radially extending portion 92 of the elbow 88 and its inlet opening 96 also rotates within the chamber 42 to describe an arcuate path of constant radius indicated in FIG. 3 by the circular center line 106. As best seen in FIGS. 3 and 4, the outer end 94 of the elbow 88 is radially curved on a radius equal to the radius of the arcuate path, and the inlet opening 96 has a laterally extended oval-shaped cross-section elongated in the direction of rotation.

To control the flow of water into the inlet opening 96, the throttling means 44 includes a continuous upstanding cylindrical band 108 of flexible, resilient material, preferably rubber, disposed radially outwardly of the arc of travel of the elbow 88 within the chamber 42, and having an outer wall surface 110 and an inner wall surface 112 in spaced, confronting relation to the inlet opening. A plurality of radially adjustable pins 114, herein sixteen in number, are disposed to project radially from the housing 40 in a circumferential horizontal array, and extend through the housing into abutting relation with the outer wall surface 110 of the band 108. By adjusting the radial position of each pin 114 to deform the band 108 radially inwardly, the radial distance between the inner wall surface 112 of the band and the inlet opening 94 of the elbow 88 can be selected, thereby to control the amount of water capable of flowing from the chamber 42 to the sprinkler nozzle 26 at any given water pressure supplied from the riser 16.

As shown in FIG. 2, the band 108 herein is supported at its upper end 116 in a circular downwardly opening groove 118 formed in the inside wall 58 of the upper section 46 of the housing 40, and at its lower end 120 in a similar circular upwardly-opening groove 122 formed in the inside wall 50 of the lower section 48 so that the band extends both above and below the radial portion 92 of the elbow 88. When seated in the grooves 118 and 122, and the upper and lower sections 46 and 48 of the housing 40 snap-fit together, the upper and lower ends 116 and 120 of the band 108 form watertiqht seals with the inside wall surfaces 50 and 58 to prevent water within the chamber 42 from leaking past the band out of the housing.

To ensure full flow of water from the chamber 42 to the sprinkler 12, the band 108 is dimensioned and mounted in the housing 40 such that when underformed by the pins 114, the radial distance between the outer end 94 of the elbow 88 and the inner wall surface 112 of the band is sufficient to provide unrestricted flow from the chamber through the inlet opening 96 to the passageway 24. With this construction, the band 108 cooperates with the upper and lower sections 46 and 48 of the housing 40 to define a pressure chamber within the chamber 42.

Figure 5:
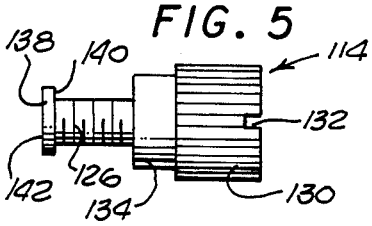
FIG. 5 is a elevational view of an adjusting pin used in conjunction with the contour control device of FIG. 1.

As can best be seen in FIGS. 2, 3 and 5, each of the pins 114 herein includes a cylindrical shank 124 having external threads 126 received in a cooperatively threaded hole 128, one half of which is formed through the upper section 46 of the housing 40, and the other half of which is formed through the lower section 48 to facilitate pin assembly, and which terminates radially outwardly of the housing in an enlarged diameter knurled knob portion 130 which includes a slot 132 to permit the blade of a screwdriver to be used to turn the pin 114, if desired. Interposed between the threaded portion of the shank 124 and the knob portion 130 is a cylindrical stop 134 of intermediate diameter and which has an inner radial surface 136 forming an abutment surface to limit movement of the pin into the chamber 42 by abutting against the outside of the housing 40 around the hole 128.

Radially inwardly of the housing 40, the shank 124 of each pin 114 terminates in a head 138 having an enlarged diameter forming an outer radial surface 140 to prevent the pin from being unthreaded fully from the hole 128, and an inner surface 142 of circular cross-section abutting against the outer wall surface 110 of the band 108. The inner surface 142 of the head 138 herein is formed to have a generally flat face, and has an overall head diameter at least as large as the smallest dimension of the inlet opening 96 and sufficiently large so that when adjacent pins 114 are threaded fully into the chamber 42 of the inner radial surfaces 136 of the stops abutting the housing 40, the peripheral margins of the heads substantially abut but do not touch each other.

Figure 6:
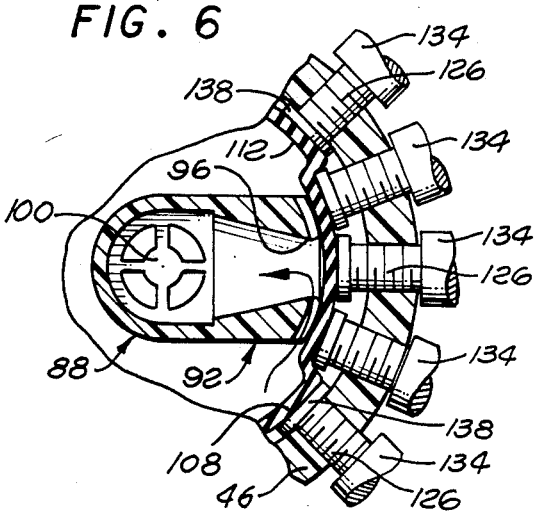
FIG. 6 is a fragmentary sectional view similar to FIG. 3 showing the adjusting pins in a different position.

As can best be seen in FIGS. 3 and 6, when a pin 114 is moved radially inwardly with respect to the housing 40 by rotating the knob 130 to thread the shank 124 into the hole 128, the head 138 will deform the flexible band 108 radially inwardly toward the arcuate path 106. This reduces the radial distance between the inner wall surface 112 of the band 108 and the inlet opening 96 as the elbow 88 rotates past the head 138 of the pin 108, thereby to throttle the amount of water flowing from the chamber 42 to the passageway 24 of the sprinkler 12. Preferably, the length of the threaded portion of the shank 124 of each pin 114 between the radial surface 136 of the stop 134 and the inner surface 142 of the head 183 is formed so that when the pin is fully threaded into the housing 40, the inner wall surface 112 of the band 108 will slidably abut the outer end 94 of the elbow 88 as the elbow rotates past the pin.

To ensure that at least the minimum flow necessary to operate the sprinkler 12 and its impact drive arm assembly 28 is provided at all settings of the throttling means 44, a pair of laterally extending channels 144 are formed in the outer end 94 of the elbow 88 and which extend to the inlet opening 96. Preferably, the channels 144 are formed to have a sufficient size such that when one or more of the pins 114 is threaded fully into the housing 40 as shown, for example, in FIG. 6, so that the inner wall surface 112 of the band 108 slidably abuts the outer end 94 of the elbow 88 to substantially cut off flow from the chamber 42 past the band to the inlet opening 96, the channels will allow a sufficient amount of water to continue to flow to the sprinkler 12 from the chamber to prevent rotation of the sprinkler from stopping.

When in use, if each of the pins 114 is positioned in a radially outward position relating to the housing 40 so that full flow from the chamber 42 to the inlet opening 96 is permitted, the wetted pattern about the sprinkler 12 will define an arc of substantially constant radius extending outwardly from the sprinkler to the maximum radial distance permitted. However, if one or more pins 114 is positioned radially inwardly with respect to the housing 40 to deform the band 108 and reduce the radial distance between the outer end 94 of the elbow 88 and the inner wall surface 112 of the band, as the sprinkler 12 and elbow rotate past the inwardly positioned pins, the flow of water into the inlet opening 96 from the chamber will be throttled thereby reducing the radial distance the wetted pattern will extend outwardly from the sprinkler.

Due to water pressure within the chamber 42 acting against the inner wall surface 112 of the band 108, the outer surface 110 of the band will be pressed against the heads 138 of the pins 114. As shown in FIGS. 3 and 6, with adjacent pins 114 in differing radial positions relative to the housing 40, the band 108 functions to provide a generally smooth and continuous throttling wall between pins and cooperates with the oval-shaped inlet opening 96 to vary the flow of water from the chamber 42 to the nozzle 26 of the sprinkler 12 as the inlet opening moves between pins.

Figure 8:
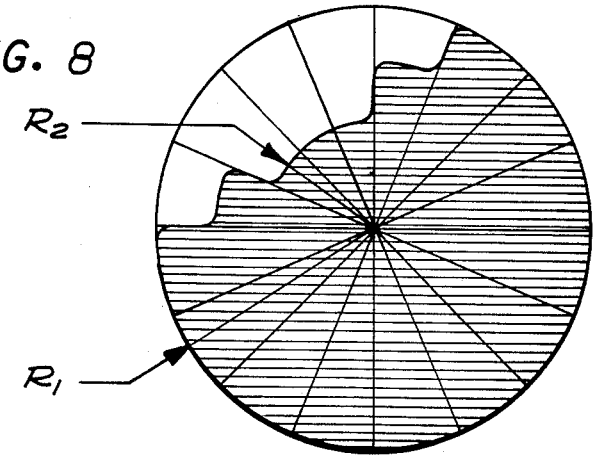
FIG. 8 is a schematic representation of the water pattern achieved by the contour control device of FIG. 1 when adjusted in accordance with the settings of FIG. 3.

In this manner, the flow of water to the sprinkler 12, and hence the radial distance the water is sprayed outwardly from the sprinkler, can be selectively controlled in accordance with the rotary position of the elbow 88 within the control device 10. With the pins 114 in the position shown in FIG. 3, for example, and the sprinkler 12 operating in a full circle mode, the wetted pattern or contour produced will have the general shape shown in FIG. 8, with the maximum radius $R_1$ corresponding to the pins threaded fully outwardly of the housing 40 and the minimum radius $R_2$ corresponding to the pins threaded fully into the housing.

Illustrated in FIGS. 9 through 12 is another embodiment of a contour control device 10' embodying the principle of the invention, with the structural or functional parts similar to those previously described in connection with the embodiment of FIGS. 1 through 8 being designated by corresponding primed reference numerals. In this embodiment, the contour control device 10' is integrally formed as a component part of a rotary drive sprinkler, herein a ball-drive type rotary pop-up sprinkler 12'.

Figure 9:
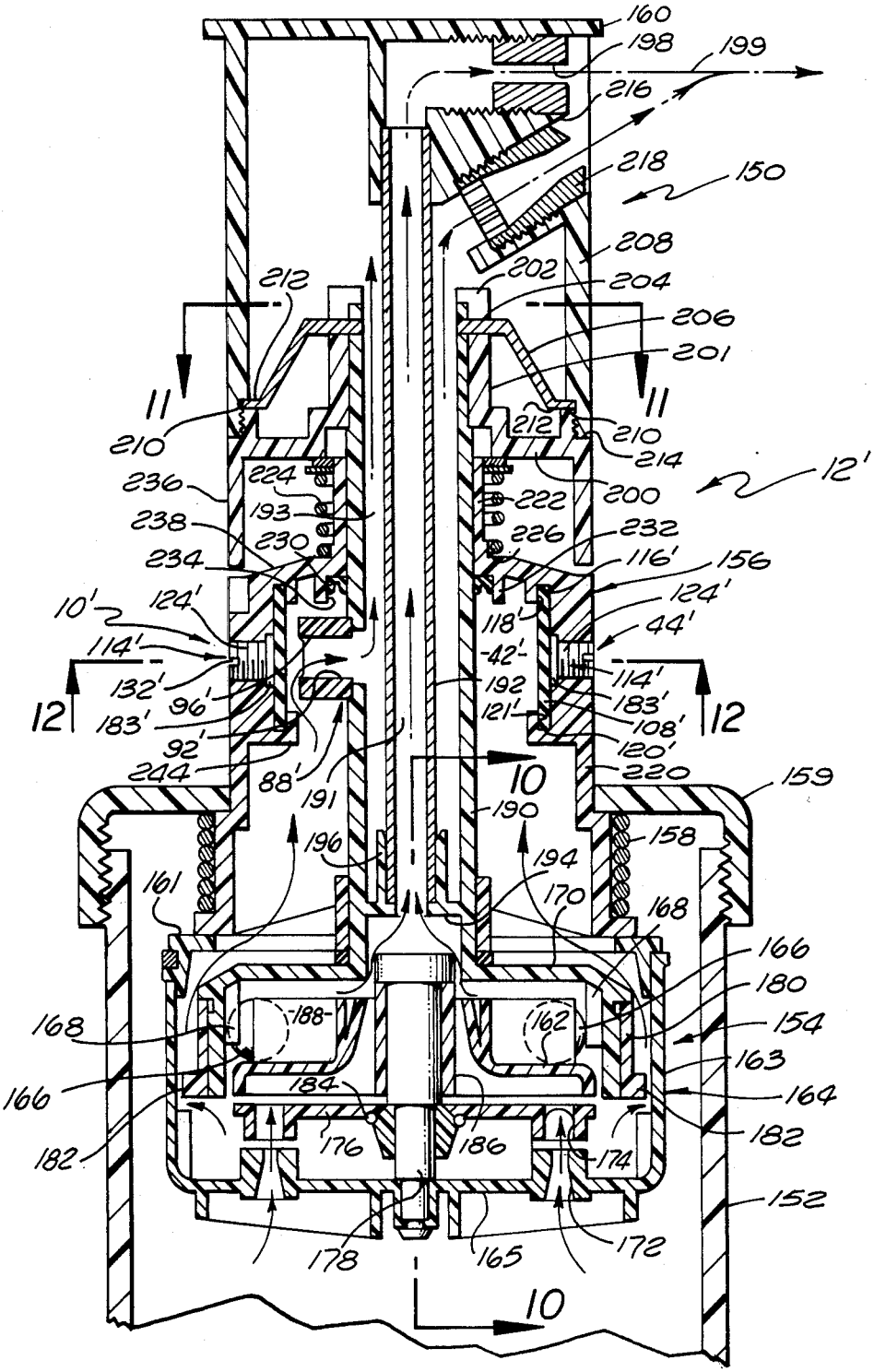
FIG. 9 is a fragmentary cross-sectional view of a second embodiment of a contour control device for rotary irrigation sprinklers and shown in conjunction with a ball drive pop-up irrigation sprinkler.
Figure 11:
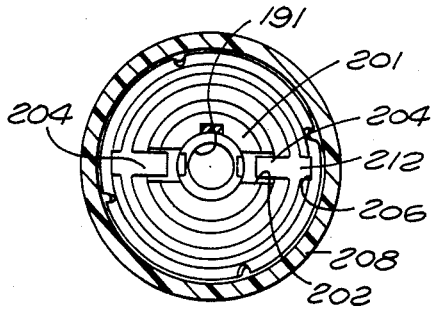
FIG. 11 is a sectional view taken along the line 11—11 of FIG. 9.
Figure 12:
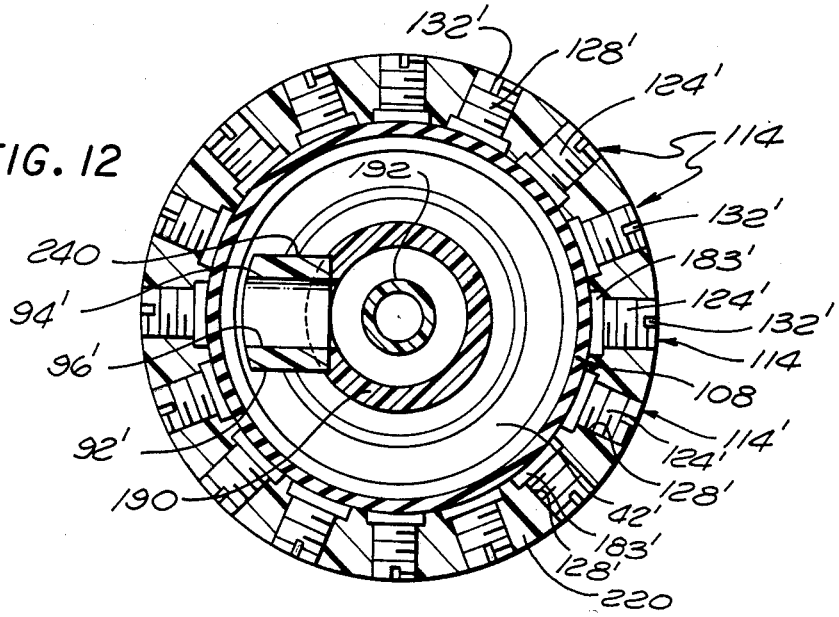
FIG. 12 is a sectional view taken substantially along the line 12—12 of FIG. 9.

As shown in FIG. 9, the sprinkler 12' includes a pop-up spray head assembly 150 movable between the extended, operative position shown, and a retracted, inoperative position wherein the spray head assembly is substantially encased within a stationary sprinkler housing 152. The spray head assembly 150 is rotatably driven in a step-wire manner about a generally vertical axis by a water-powered rotary drive assembly 154 encased within the housing 152 which is coupled at its lower end (not shown) to a water supply source (also not shown) from which pressurized water is supplied into the housing.

In this instance, the rotary drive assembly 154 is substantially the same as that disclosed in U.S. Pat. No. 4,625,914 issued Dec. 2, 1986, entitled Rotary Drive Sprinkler and assigned to Rain Bird Consumer Products Mfg. Corp., the assignee of this application. For a more detailed description of the rotary drive assembly 154 as hereinafter briefly described, reference can be made to the foregoing issued patent.

As shown, the spray head assembly 150 of the sprinkler 12' is mounted at the upper end, and comprises a portion of a pop-up stem assembly 156 which, in turn, is supported at its lower end by the rotary drive assembly 154, with the pop-up stem and rotary drive assemblies comprising a pop-up unit carried within the sprinkler housing 152 for sliding movement between the retracted position and the elevated spraying position shown in FIG. 9. A retraction spring 158 such as a helical compression spring is coiled about the pop-up stem assembly 156 and reacts between the underside of a removable, centrally apertured cover 159 threaded to the axially upper end of the housing 152, and an upwardly presented surface at the lower end of the pop-up stem assembly 156 to urge the entire pop-up unit normally toward the retracted position. When retracted, a spray head cap 160 on the spray head assembly 150 has its peripheral margin seated upon the axially upper end of the cover 159.

When irrigation water under pressure is supplied to the sprinkler housing 152, the pressure of the water overcomes the downward biasing force of the retraction spring 158 causing the rotary drive assembly 154 and the pop-up stem assembly 156 to displace upwardly to the elevated spraying position shown in FIG. 9. In this position, a portion of the water supplied to the sprinkler 12' is directed into driving relation with the rotary drive assembly 154 to rotatably drive the spray head assembly 150 through a succession of relatively small rotational steps. This drive portion of the water is recombined with the remaining or bypass water portion for projection radially outwardly from the spray head assembly 150 as an irrigation water stream which is thus swept in a series of small rotational steps over adjacent terrain for irrigation purposes.

The rotary drive assembly 154 herein comprises a balanced ball drive assembly having a water-driven turbine or impeller 162 mounted for rotation within a drive case 164 and carrying at least two symmetrically disposed impact balls 166 for repetitive, substantially simultaneous impact with anvils 168 on a rotatably mounted drive sleeve 170 forming a portion of the pop-up stem assembly 156. The succession of ball impacts with the anvils 168 rotatably drives the drive sleeve 170 through a succession of relatively small rotational steps to correspondingly rotate the spray head assembly 150 mounted at the upper end of the drive sleeve. Herein, the drive case 164 has a generally cup-shaped configuration and includes an upstanding sidewall 163 fitted with an operational cap 161 at its upper end and against which the retraction spring acts, and a lower wall 165 supporting means for dividing the flow of water entering the housing 152 into a first drive water portion for driving the ball drive assembly, and a second bypass portion which is directed around the ball drive assembly.

The lower wall 165 of the drive case 164 is shaped to define a diametrically opposed pair of drive jet nozzles or ports 172 for upward passage of a pair of relatively high velocity drive jets into driving relation with the balls 166 of the rotary drive assembly 154. The drive jets are each directed upwardly toward an overlying respective set of adjacent swirl ports 174 formed near the periphery of a generally circular swirl plate 176. This swirl plate 176 is rotatably supported within the drive case 164 by an upstanding spindle 178 having a foot anchored by snap-fit engagement or the like into the drive case lower wall 165. Each set of swirl ports 174 comprises a pair of contoured openings, one of which is aligned for receiving the associated upwardly directed drive jet and for turning the drive jet in a generally clockwise circumferential direction within the drive case 164 and the other for turning the drive jet in a generally counter-clockwise circumferential direction. With this arrangement, which is generally conventional in part circle ball drive sprinklers, the sprinkler 12' can be driven in a forward or reverse direction by positioning one or the other of the sets of swirl ports 174 to receive the drive jet from the jet nozzles 172. To control which of the sets of swirl ports 174 are aligned with the jet nozzles 172, an adjustable trip ring 180 is mounted to the drive sleeve 170, and has a radially projecting trip stop tab 182 which operates a spring trip wire 184 projecting from the swirl plate 176.

Figure 10:
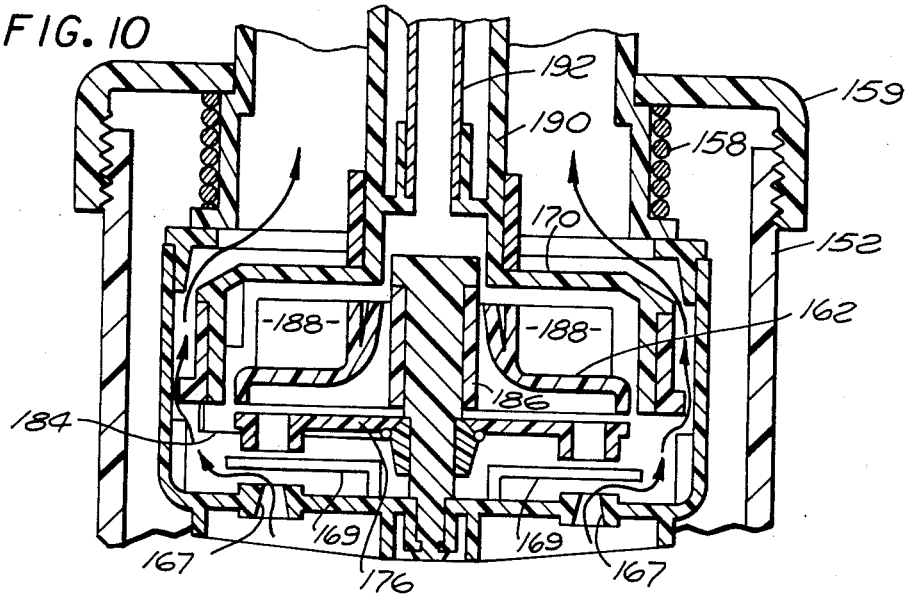
FIG. 10 is a fragmentary sectional view taken along the line 10—10 of FIG. 9.

As best seen in FIG. 10, the lower wall 165 of the drive case 164 further includes a diametrically opposed pair of bypass flow ports 167 over which are disposed a pair of radially outwardly open hoods 169. The hoods 169 function to guide the bypass water flow from the bypass ports 167 in a generally radially outward direction at the bottom of the drive case 164 and beneath the swirl plate 176 for upward bypass flow around the water turbine 162.

The water turbine 162 comprises a generally bell-shaped body oriented to open in a downward direction and including a central hub 186 rotatably carried about the upright spindle 178 at a position above the swirl plate 176. A plurality of outwardly radiating upright vanes 188 are engaged by the swirling drive jet water discharged from the swirl ports 174 to rotatably drive the water turbine 162. Water-driven rotation of the turbine 162 throws the impact balls 166 which are constrained between the pairs of vanes 188, radially outwardly toward their solid line positions as illustrated in FIG. 9 for impact against the anvils 168 to rotate the drive sleeve 170.

The drive sleeve 170 narrows at a position spaced slightly above the impact balls 166 and the vanes 188 of the turbine 162, and projects axially upwardly as a cylindrical tube portion 190 of generally circular cross-section to the spray head assembly 150. Disposed concentrically within the tube portion 190 is an open ended tubular sleeve 192 of reduced cross-sectional size and which defines an inner flow passage 191 centrally through the sleeve and an outer flow passage 193 in the annulus between the sleeve outer surface and the inner surface of the tube portion. The sleeve 192 is herein secured at its lower end within the tube portion 190 by a press-fit connection with a socket formed by a radially inwardly projecting annular wall 194 having an upstanding cylindrical flange 196 dimensioned to receive the lower end of the tubular sleeve and forming an opening to the inner flow passage 191 and a closed bottom for the outer flow passage 193.

Upon leaving the area of the turbine 162, the drive water is vented directed upwardly through the inner flow passage 191 of the tubular sleeve 192 within the tube portion 190 of the drive sleeve 170 to the spray head assembly 150. In this instance, the upper end of the tubular sleeve 192 communicates with a discharge nozzle 198 coupled with the underside of the cap 160 to eject the drive water portion radially outwardly from the sprinkler 12', as shown by the arrow 199.

The spray head assembly 150 comprises a preassembled unit conveniently adapted for snap-fitted mounting directly onto the upper end of the drive sleeve 170 in a selected rotational position with respect to the drive sleeve. More particularly, as shown best in FIGS. 9 and 11, the illustrative spray head assembly 150 comprises a generally cylindrical base portion 200 having an upstanding cylindrical portion 201 of reduced diameter and which includes diametrically opposed notches 202 in the upper end for rotationally prealigned reception of radially inwardly projecting snap tabs 204 on a retainer cage 206. A generally cylindrical spray head housing 208 is received over the spray head base portion 200 and includes internal shoulders 210 for seating a lower rim 212 of the retainer cage 206 firmly upon an enlarged lower end seat 214 of the spray head base portion 200. The spray head housing 208 is rotationally positioned on the spray head base portion 200 to orient a laterally open and upwardly inclined main nozzle port 216 and associated main nozzle 218 in a selected arcuate location relative to the snap tabs 204, after which these components are securely fastened together by means of a sonic weld, adhesive or the like.

The spray head assembly 150 and the underlying drive sleeve 170 are axially movable up and down through a short stroke relative to the drive case 164 and further with respect to a nonrotational riser 220 projecting upwardly from the drive case and forming a portion of the pop-up stem assembly 156. More specifically, the riser 220 has a generally cylindrical shape surrounding a lower portion of the drive sleeve 170 and including an upper guide sleeve 222 of reduced diameter within which the tube portion 190 of the drive sleeve 170 is slidably supported. A compression spring 224 reacts between an upwardly presented shoulder 226 on the riser guide sleeve 222 and the downwardly presented surface of the spray head base portion 200 to urge the spray head and drive sleeve upwardly within the riser guide sleeve 222. An annular packing seal 230 of U-shaped cross-section is interposed between a downwardly projecting flange 232 forming a circumferential shoulder 234 at the lower end of the riser guide sleeve 222 and the outer surface of the tube portion 190 of the drive sleeve 170 to prevent water leakage therebetween, and confines bypass water flow for passage through the annular space 193 between the drive sleeve 170 and the outer surface of the tubular sleeve 192. An annular skirt 236 conveniently depends from the spray head base portion 200 to surround and substantially conceal the spring 224 while permitting a limited degree of vertical motion between the lower margin of the skirt and a radially enlarged land 238 on the riser guide sleeve 222.

In accordance with the present invention, the flow control device 10' is integrally formed as a part of the pop-up stem assembly 156 with an adjustable throttling means 44' being formed as part of the riser 220. A chamber 42' is formed around the tube portion 190 of the drive sleeve 170 and defined, generally, by the downwardly facing lower surface of the riser guide sleeve 222, the apertured cap 161, and the inner and outer walls of, respectively, the riser 220 and the drive sleeve 190. Bypass water from the bypass ports 167 is directed radially outwardly and then upwardly around the water turbine 162 into the chamber 42', past the adjustable throttling means 44', and into the outer flow passage 193 formed by the annulus between the outer wall of the tubular sleeve 192 and the inner wall of the tube portion 190 of the drive sleeve 170 for discharge from the main nozzle 218.

As best seen in FIGS. 9 and 10, to direct water from the chamber 42' into the outer flow passage 193, the tube portion 190 of the drive sleeve 170 is provided with a radially directed tubular extension 92' adjacent the throttling means 44' and which defines an inlet opening 96' to the chamber. In this instance, the extension 92' is formed as a cylindrical tube 240 having a radially curved outer end face 94' which is securely attached, such as by bonding, welding, or press fit to the drive sleeve 170, and has an inlet opening 96' of laterally extended, oval-shaped cross-section.

Preferably, the extension 92' is formed on the drive sleeve 170 such that the center line of the inlet opening 96' can be aligned with the center-line of the main nozzle 218. This can be achieved by forming the notches 202 and cooperating tabs 204 to be aligned so that when the spray head assembly 150 is snap-fit onto the drive sleeve 170, the radially directed portions of the center lines of the inlet opening 96' and the main nozzle 218 are along parallel axes.

To control the flow of water from the chamber 42' into the inlet 96', the throttling means 44' includes an annular, continuous flexible band 108' mounted at its upper end 116' in a circular downwardly opening groove 118' formed in the lower end of the riser guide sleeve 222, and at its lower end 120', in an upwardly opening groove 122' formed in a radially inwardly projecting wall portion 244 of the riser 220 below the guide sleeve. A plurality of radially adjustable pins 114' project through the sidewall of the riser 220 and have enlarged, diameter heads 183' abutting the band 108'.

Each of the pins 114' has a threaded shank 124' received in a cooperatively threaded hole 128' formed in the riser 220, and a slot 132' formed in the outer end of the pin suitable for receiving the blade of a screwdriver to facilitate advancing and retracting the pin. Preferably, the length of the threaded shank 124', as illustrated in FIG. 9, is such that when the pins 114' are unthreaded fully to their radially outer positions, the outer ends will be flush with the outer surface of the riser 220 so as not to interfere with extension and retraction of the pop-up stem assembly 156 relative to the housing 152.

In operation, water flowing through the bypass flow ports 167 is deflected by the hoods 169 to flow around the drive case 164 with the chamber 42'. As the tube portion 190 of the spray head assembly 150 is rotatably driven by the drive assembly 154, water from the chamber 42' is admitted into the inlet 96' and flows upwardly through the annulus 193 to the spray head assembly 150 where the water is ejected by the nozzle 218 radially outwardly and upwardly away from the sprinkler 12'. Herein, the drive water ejected from the discharge nozzle 198 intercepts the stream from the main nozzle 218 and is combined therewith so that a single stream of water is thrown outwardly from the sprinkler.

By controlling the radial distance between the inner surface 112' of the band 108' and the outer end face 94' of the tubular extension 92', the amount of water permitted to flow from the chamber 42' to the main nozzle 218 can be controlled for any rotary position of the nozzle relative to the housing 152. It should be noted that since the water flowing through the drive case lower wall 165 is divided into a drive water portion and a bypass portion, the minimum flow necessary to drive the sprinkler 12' will always be present even if all of the pins 114' are fully threaded radially inwardly so that substantially all flow past the band 108' from the chamber 42' to the inlet 96' is cut off. Thus, with the embodiment of FIGS. 9 through 12, no lateral flow channels such as channel 144 of the embodiment of FIGS. 1 through 5 are required in the outer end 94' of the tubular extension 92'.

In a test of an impact drive sprinkler of the type shown in the embodiment of FIG. 1 having a 5/32 inch nozzle mounted to a control device as described herein, it was found that the following approximate maximum and minimum radial distances from the sprinkler were attained when water at the stated pressure was supplied to the control device from the riser:

| Water Supply Pressure In Pounds Per Square (p.s.i.) | Radial Distance From Sprinkler In Feet (ft.) | |
|---|---|---|
| | maximum | minimum |
| 40 p.s.i. | 23 ft. | 14 ft. |
| 50 p.s.i. | 26 ft. | 15 ft. |
| 60 p.s.i. | 28 ft. | 16 ft. |
| 70 p.s.i. | 29 ft. | 17 ft. |
| 80 p.s.i. | 31 ft. | 18 ft. |

Thus, it can be seen that by use of the flow control device 10 of the present invention, a rotary sprinkler 12 can be controlled to irrigate surface areas having highly irregular shapes or contours. Moreover, the control device 10 is quickly and easily adjusted and operates in a reliable and effective manner to permit control over relatively wide limits of substantially any type rotary sprinkler device having a body adapted for rotation about an axis and an inlet through which water from a preassigned source is received and which rotates together with the body about the axis.

A variety of modifications and improvements to the invention described herein are believed to be apparent to those skilled in the art. Accordingly, no limitation on the invention is intended, except by way of the appended claims.

What is claimed is:

1. A contour control device for use with a rotary irrigation sprinkler of the type including a body adapted for rotation about an axis and having an inlet through which water from a pressurized source is received, and means for rotating said body together with said inlet about said axis, said control device comprising:

means for coupling said sprinkler body to said housing for relative rotation;

a generally cylindrical chamber formed within said housing;

means for coupling said chamber with said pressurized water source;

means defining a radially opening inlet from said chamber to said sprinkler inlet and fixed for rotation with said sprinkler body; and throttling means for controlling the flow of water from said chamber into said sprinkler inlet including a deformable band having a wall extending peripherally about said chamber and normally disposed in radially spaced, confronting relation with said radially extending inlet, and means for adjusting the radial spacing of said wall relative to said radially extending inlet to control the flow of water from said chamber into said sprinkler inlet in accordance with the rotary position of said sprinkler body relative to said housing.

2. A contour control device as set forth in claim 1 wherein said band is a continuous band formed of flexible, elastic material.

3. A contour control device as set forth in claim 2 wherein said material is rubber.

4. A contour control device as set forth in claim 1 wherein said means for adjusting comprise a plurality of pins having inner ends engaged with said wall and outer ends projecting from said housing, each of said pins being radially adjustable relative to said wall.

5. A contour control device as set forth in claim 4 wherein said band is a continuous band formed of flexible, elastic material.

6. A contour control device as set forth in claim 1 wherein said radially extending inlet means includes a generally L-shaped tubular elbow having one end coupled within said sprinkler inlet and an opposite end opening radially into said chamber.

7. A contour control device as set forth in claim 6 wherein said tubular elbow includes vanes projecting toward said sprinkler inlet for straightening the flow of water received from said opposite end opening as it flows into said sprinkler inlet.

8. A contour control device as set forth in claim 6 wherein said opposite end opening has an elliptical shape elongated in the direction of rotation of said sprinkler body.

9. A contour control device as set forth in claim 6 wherein said opposite end opening includes flow grooves for permitting water to flow from said chamber into said sprinkler inlet regardless of the radial spacing between said wall and said radially extending inlet.

10. A contour control device as set forth in claim 4 wherein each of said pins is radially adjustable between a first position with said inner end spaced radially from said radially extending inlet an amount sufficient to permit substantially unrestricted flow of water from said chamber into said sprinkler inlet, and a second position with said inner end deforming said wall into sliding contact with said radially extending inlet to substantially prevent water from flowing from said chamber past said wall into said sprinkler inlet.

11. A contour control device as set forth in claim 10 wherein said radially extending inlet means includes a generally L-shaped tubular elbow having one end coupled within said sprinkler inlet and an opposite end opening radially into said chamber.

12. A contour control device as set forth in claim 11 wherein said opposite end opening has an elliptical shape elongated in the direction of rotation of said sprinkler body.

13. A contour control device as set forth in claim 11 wherein said opposite end includes at least one flow groove for permitting limited water flow into said sprinkler inlet when said pins are in said second positions.

14. A contour controlled rotary irrigation sprinkler for connection to a pressurized water source comprising:

a sprinkler body having a downwardly extending, vertically disposed tubular stem having a lower end and adapted for rotation about a generally vertical axis;

a radially opening inlet at the lower end of said stem;

an outlet nozzle coupled with said body;

a water passageway extending through said body and said stem between said inlet and said outlet;

an oscillating drive arm assembly mounted on said body for rotating said body and said stem about said axis;

a housing having a generally cylindrical chamber formed therein;

means for mounting said sprinkler to said housing for relative rotation with said inlet disposed within said chamber;

means for coupling said housing to said pressurized water source for admitting water to said chamber;

a deformable band having a generally vertically oriented wall extending peripherally about said chamber within said housing and normally disposed in radially spaced, confronting relation with said inlet; and means for adjusting the radial spacing of said wall relative to said inlet to control the flow of water from said chamber into said inlet in accordance with the rotary position of said body and said stem relative to said housing.

15. A contour controlled rotary irrigation sprinkler as set forth in claim 14 wherein said adjusting means includes a plurality of pins disposed in a radial array about said housing, each of said pins being individually adjustable in a radial direction and having an inner end abutting said wall and an outer end projecting outwardly of said housing.

16. A contour controlled rotary irrigation sprinkler as set forth in claim 15 wherein said band is a continuous band formed of an elastic, flexible material.

17. A contour controlled rotary irrigation sprinkler as set forth in claim 16 wherein said pins have threaded shank portions between said inner ends and said outer ends, and are mounted in cooperatively threaded holes formed in said housing.

18. A contour controlled rotary irrigation sprinkler as set forth in claim 17 wherein said housing and said pins are formed of plastic, and said band is formed of rubber.

19. A contour controlled rotary irrigation sprinkler as set forth in claim 15 wherein said stem includes a radially extending tubular portion defining said radially opening inlet.

20. A contour controlled rotary irrigation sprinkler as set forth in claim 19 wherein said inlet has an elliptical shape elongated in the direction of rotation.

21. A contour controlled rotary irrigation sprinkler as set forth in claim 20 wherein said band is a continuous band and each of said pins has a threaded shank portion between said inner end and said outer end, and is mounted in a cooperatively threaded hole formed in said housing.

22. A contour controlled rotary irrigation sprinkler as set forth in claim 21 wherein said band is formed of rubber and said housing and said pins are each formed of plastic.

23. A contour controlled rotary irrigation sprinkler as set forth in claim 15 wherein said means for mounting said sprinkler comprises a tubular journal bore formed by said housing projecting above said chamber, said journal bore being sized to surround and support said stem for rotation about said axis.

24. A contour control device for use with a rotary irrigation sprinkler of the type including a body having a downwardly and generally vertically extending tubular stem adapted for rotation about a generally vertical axis with an axially opening inlet at the lower end, said contour control device comprising:

a housing having a generally cylindrical chamber of circular horizontal cross-section formed therein;

means for mounting said sprinkler to said housing for relative rotation with said inlet disposed within said chamber;

a tubular elbow having an axially directed opening coupled with said sprinkler inlet and a radially-extending portion terminating in a face having a radially opening inlet to said chamber, said tubular elbow being fixed for rotation together with said stem relative to said housing;

a continuous deformable band having a generally vertical wall extending peripherally about said chamber and normally disposed in radially-spaced, confronting relation with said face and said radially-opening inlet, said wall extending both above and below said radially opening inlet; and a plurality of pins having inner ends abutting said wall and outer ends projecting radially from said housing, each of said pins being mounted to said housing for radial movement between a first inner position with said inner end deforming said wall into sliding contact with said face and a second outer position with said wall in said normally disposed spaced relation with said face and said radially-opening inlet.

25. A contour control device as set forth in claim 24 wherein said means for mounting said sprinkler includes a cylindrical journal bore formed by said housing above said chamber, said bore being sized to surround and support said stem for relative rotation.

26. A contour control device as set forth in claim 25 wherein said housing includes an upper generally bell-shaped housing portion and a lower generally cup-shaped housing portion, said journal bore being formed in said upper housing portion, and said lower housing portion including means for coupling said chamber with a source of pressurized water.

27. A contour control device as set forth in claim 26 wherein said band has an upper end disposed in sealing engagement with said upper housing portion and a lower end disposed in sealing engagement with said lower housing portion.

28. A contour control device as set forth in claim 24 wherein each of said pins has a threaded shank portion between said inner end and said outer end, and said housing includes cooperatively threaded holes through which said shank portions extend.

29. A contour control device as set forth in claim 24 wherein said band is formed of rubber and said housing and pins are each formed of plastic.

30. A contour control device as set forth in claim 24 wherein said radially-opening inlet is elliptical in shape elongated in the direction of rotation.

31. A contour control device as set forth in claim 24 wherein said elbow includes a means for permitting limited water flow from said chamber to said radially opening inlet when said pins are in said first positions.

32. A contour control device as set forth in claim 31 wherein said means for permitting limited water flow comprises at least one groove formed in said face extending between said radially opening inlet and said chamber.

33. A contour controlled rotary irrigation sprinkler comprising:

a housing having a generally cylindrical chamber formed therein;

means for coupling said chamber with a source of pressurized water;

an irrigation spray head coupled to said housing for rotation relative thereto about a generally vertical axis, said spray head including a water inlet disposed in said chamber and a water outlet through which water is discharged from said spray head, said inlet opening radially to said, chamber and rotatable with said spray head about said axis; and adjustable throttling means comprising a continuous deformable band of flexible, elastic material and having a wall extending peripherally about said chamber normally disposed in radially-spaced, confronting relation with said radially opening inlet and a plurality of pins engaging said band disposed within said chamber for selectively controlling the volume of water flowing from said chamber into said inlet in accordance with the rotary position of said spray head relative to said housing.

34. A contour controlled rotary irrigation sprinkler as set forth in claim 33 wherein said pins are radially adjustable and have inner ends engaging said wall to selectively deform said wall radially toward said radial inlet.

35. A contour controlled rotary irrigation sprinkler as set forth in claim 34 including motor means coupled to said spray head for rotating said spray head about said axis.

36. A contour controlled rotary irrigation sprinkler as set forth in claim 35 wherein said motor means is a ball drive mechanism.

37. A contour controlled rotary irrigation sprinkler as set forth in claim 36 wherein said radially-opening inlet comprises a cylindrical tube projecting into said chamber and said inlet opening has a generally elliptical shape elongated in the direction of rotation.

38. A contour controlled irrigation sprinkler as set forth in claim 37 wherein said band is formed of rubber and said pins are each formed of plastic.

39. For use with a rotary irrigation sprinkler having a body adapted for rotation about a generally vertical axis, the body including a water inlet for receiving water from a pressurized source and a water outlet through which water is discharged radially from the sprinkler, a contour control device comprising:

a housing having a chamber formed therein;

means for coupling said chamber to said pressurized water source;

means for mounting said sprinkler body to said housing for rotation relative thereto and with said inlet disposed within said chamber;

means coupled with said inlet for forming a radially-extended passageway having an inlet opening through which water from said chamber is admitted to said inlet; and adjustable throttling means disposed within said chamber for selectively controlling the flow of water from said chamber into said inlet opening of said radially-extended passageway in accordance with the rotary position of said body relative to said housing, said adjustable throttling means including a deformable band having a wall extending peripherally about said chamber and normally disposed in radially-spaced confronting relation with said inlet opening of said radially-extended passageway, and means for adjusting the radially spacing of said wall relative to said inlet opening.

40. A contour control device as set forth in claim 39 wherein said means for adjusting comprises a plurality of pins having inner ends engaged with said wall, each of said pins being radially-adjustable relative to said wall.

41. A contour control device as set forth in claim 40 wherein said band is a continuous band formed of flexible, elastic material.

42. A contour control device as set forth in claim 41 wherein said flexible, elastic material is rubber and said pins are each formed of plastic.

* * * * *